United States Patent [19]

Archibald

[11] Patent Number: 4,974,536

[45] Date of Patent: Dec. 4, 1990

[54] RECOVERABLE TETHERED PLATFORM SYSTEM

[76] Inventor: Thomas E. Archibald, Norton, Mass. 02766

[73] Assignee: EG&G International, Inc. 45 William Street Wellesley, Ma. 02181

[21] Appl. No.: 252,061

[22] Filed: Sep. 30, 1988

[51] Int. Cl.[5] ..... B63B 21/66; B63G 8/42

[52] U.S. Cl. ..... 114/244; 114/254; 114/312

[58] Field of Search ..... 114/244, 245, 253, 254, 114/294, 312; 441/24–26; 367/4, 3, 131

[56] References Cited

U.S. PATENT DOCUMENTS 3,281,765 10/1966 Taplin ..... 367/4

3,372,665 3/1968 Mesler ..... 114/294

3,398,715 8/1968 Burg ..... 114/253 X

*Primary Examiner*—Sherman D. Basinger

[57] ABSTRACT

This invention relates to a recoverable tethered platform system and to a tethered platform for use therewith. One end of a tether line is retained at a surface station while the majority of the line is initially mounted on a mandrel in the platform and is drawn from this mandrel as the platform descends. This permits more rapid descent of a platform since there are substantially no line drag forces to overcome during descent. During recovery, the line can be wrapped on a mandrel which is the same as the mandrel in the platform and this rewound mandrel may then be substituted for the empty mandrel in the platform for redeployment.

21 Claims, 3 Drawing Sheets

RECOVERABLE TETHERED PLATFORM SYSTEM

FIELD OF THE INVENTION

This invention relates to platforms or probes for use, for example, in oceanographic work and more particularly to a recoverable tethered platform with controlled deployment and recovery rates.

BACKGROUND OF THE INVENTION

In oceanographic work, submarine detection, and other applications, it is desirable to be able to lower instruments from a ship, oil rig, helicopter, or other station positioned at or above the water surface, preferably at a controlled rate and to a selected depth. Such instruments might, for example, make measurement profiles of physical properties of the ocean such as temperature, current velocities or salinity of the water, may collect water samples or samples from the ocean floor, may be used as a transport platform for equipment to detect submarines, fish, underseaflora, fauna, or rock formations, etc. While, particularly with the advent of microprocessors and memory chips having large capacities, the quality and sophistication of such equipment has been advancing rapidly, there have been few advances in the platforms for deploying such instruments and equipment.

Heretofore, such platforms have generally been of two types. One type of platform, which are referred to as disposables, are thrown from a ship, airplane or helicopter and return data to shipboard instruments or to airborne instruments via radio transmitters.

These devices have a number of disadvantages. First, they require a conductive cable which is fed out at the surface and/or from the platform as the platform descends. In some cases, such platforms permit readings to be taken only as the platform descends. For example, assuming that the depth of the water is greater than the length of the wire, the wire breaks when the platform reaches the end of the wire aborting any further transmission of data. In other cases, the platforms reach the end of their cable and continue to transmit data until the device either self destructs, is discarded, or wears out.

Since these platforms permit moving readings to be taken only while the platform is descending, there is no easy way to check the readings other than to deploy a second platform. The data which can be collected is also limited to data which can be quickly and easily transmitted and such platforms cannot, of course, be utilized for collecting water or soil samples or for other experiments which require that the instrument be recovered.

Finally, there is reluctance to use high cost instruments in a disposable platform, limiting the experiments which can be conducted using such platforms or probes, and/or making their use relatively expensive.

A second type of platform is a recoverable tethered platform wherein the platform with the instruments is lowered from for example a ship, the platform being attached to the end of a cable which cable is played out from a suitable level wind winch mandrel on the ship. The platform is retrieved by reversing the direction of rotation of the mandrel to rewind the cable on the mandrel.

These systems also have a number of disadvantages. One of the problems with existing systems where the cable is fed from the ship is superposition of the dynamics of the rolling surface vessel on the dynamics of the descending instrument. This causes non linearities in the readings obtained which, because of their somewhat random nature, are difficult to compensate for. In high seas, the motion of the system becomes a complex combination of different component motions, particularly as the platform approaches its terminal descent velocity. The cyclic motion at the surface is superimposed on the descent rate of the cable and platform. Typically the platform has a non uniform shape which due to fluid drag results in a lesser terminal velocity than that of the cable. When the downward cyclic component of motion adds to the descent rate it may temporarily result in slack cable between the platform and cable or between the cable and ship. This may result in catastrophic cable failure.

Further, such systems generally employ metal cable and are thus relatively heavy in the water requiring relatively large and relatively high powered equipment to both deploy and recover the platform. The size and weight of such equipment may require the use of a larger, and thus normally more expensive, ship than if smaller and lighter equipment could be utilized.

Since ship time is very expensive, it is often desirable that the time required to take a single set of readings be substantially reduced by increasing the fall rate of the platform from 1 to 2 meters per second to something in the 6 meter to 10 meter per second range. In the case of 6000 meter deep ocean experiments this could reduce the time for an experiment from 3 hours to ½ hour, with significant resulting cost savings.

It is therefore a primary object of this invention to provide a recoverable oceanographic platform which will substantially reduce the on station time required for deployment and recovery.

A more specific object of this invention is to increase the rate at which the platform may descend by removing limitations due to cable drag and to system dynamics such as the problem of cyclic motion of a very large mass-momentum (ship-cable platform) system.

Another object of this invention is to provide a recoverable tethered platform for oceanographic use which substantially isolates the platform from the dynamics of the vessel, thus eliminating the somewhat random errors in readings which may occur in some prior art systems as a result of such dynamics.

Still another object of the invention is to reduce the size, weight and cost of the on vessel equipment utilized for a recoverable tethered platform thereby permitting a smaller vessel to be utilized for such deployment.

While in the discussion above, it has been assumed that the ship or other station from which the instrument platform is being deployed is stationary, similar problems arise where the ship or other station is moving at a speed of up to for example 10 knots during deployment and recovery.

SUMMARY OF THE INVENTION

In accordance with the above, this invention provides a tethered platform system and a tethered platform for use therein. The tethered platform includes a mandrel, a line of high tensile strength, high modulus fiber wrapped on the mandrel, and a payload commonly mounted with the mandrel, the mandrel being removably mounted, a means for permitting line to be fed from the mandrel as the platform is deployed and a mean for securing the distal end of the line to the mandrel or other portions of the platform. For the preferred embodiment, at least one, and preferably both, of the mandrel and the payload are mounted in a hydrodynamically stable body. The platform preferably includes means for stabilizing it at least during deployment and means for reducing maximum tension applied to the line when the platform is being stopped at the end of deployment.

The platform is designed to allow any unsealed internal voids to fill with water as it is lowered into the water. During descent the viscous nature of the water serves to dampen the motion of the line as it is pulled off the mandrel, thereby reducing the likelihood of tangling due to loose coils of line on the mandrel.

The line is preferably of a material which is approximately neutrally buoyant in water so that as water displaces the line during payout, the buoyancy of the platform remains substantially unchanged during descent.

The remainder of the system includes the shipboard recovery elements. This includes a mandrel which is substantially the same as the removable mandrel on the platform, a precision winding mechanism to which the mandrel may be mounted, and a grooved two drum cutlass or other suitable mechanism for hauling the tether during recovery of the platform. The recovery mandrel, when line has been fully wound thereon, is adapted to replace the removable mandrel in the body, the platform with the new mandrel and line then being ready to be redeployed.

The precision winder preferably is adapted to wind line on the mandrel with one twist per revolution. The tension of the line which is fed to the winder is maintained within certain limits in order to prevent loose line on the mandrel.

In the case of very deep deployments or during high speed recoveries it may be necessary to tension limit the hauling mechanism. The hauling force necessary to overcome drag from the combination of speed and tether length in the water can stress the line t levels that exceed the working strength of the line. Line breakage is prevented by limiting the maximum power of the hauling mechanism.

The foregoing and other objects, features and advantages of the invention will be apparent from the following more particular description of a preferred embodiment of the invention as illustrated in the accompanying drawings.

IN THE DRAWINGS

DETAILED DESCRIPTION

Figure 1:
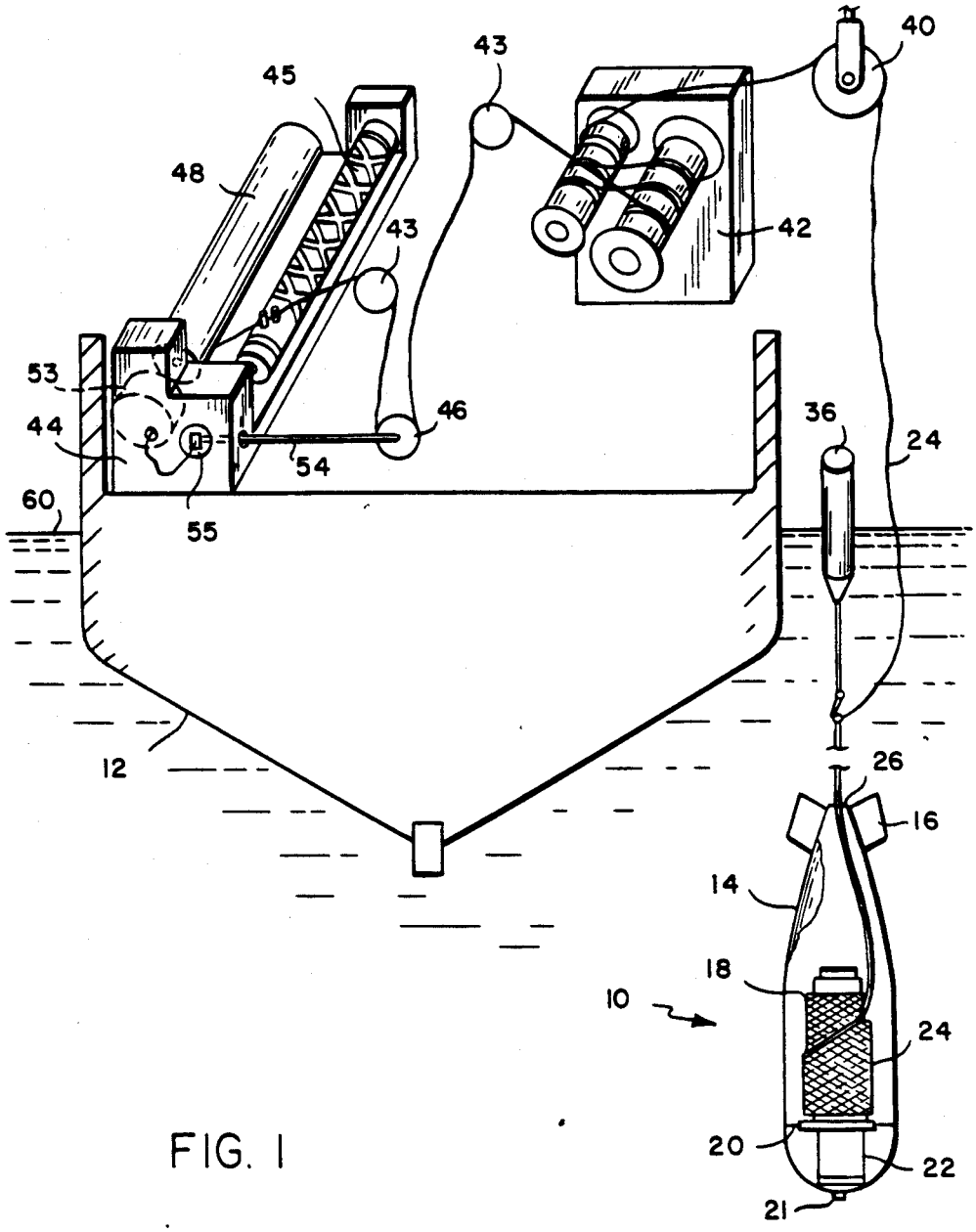
FIG. 1 is a semi schematic diagram showing the various elements of the tethered platform system of a preferred embodiment of the invention when the platform is descending.

In the figures, the tethered platform 10 is deployed from a boat, oil platform, or other stationary or moving station 12. The platform 10 is formed of a generally hydrodynamically shaped body 14. Body 14, should be symmetric so as to assure stability of the body as it descends. Tail fins 16 may be provided at the stern of the body to enhance stability. A mandrel 18 is mounted in the body 14 with its axis substantially coaxial with the center stem-to stern axis of the body 14. A bracket 20, screw 21 and/or other suitable means may be provided for supporting the mandrel 18 in body 10. A container 22 is fitted through the center of mandrel 18 and is adapted to contain the payload of the platform. Depending on the nature of the payload, it may also be mounted either above or below the mandrel or otherwise positioned in body 14 and some portion of body 14 may also serve as part of the container 22. However, in order for the platform to fall without excess wobble or spinning, the weight distribution of the payload and the payload container should be substantially symmetrical about the center stem-to stern axis of the platform. Container 22 may, for some instruments, be sealed so as to be watertight.

Figure 2:
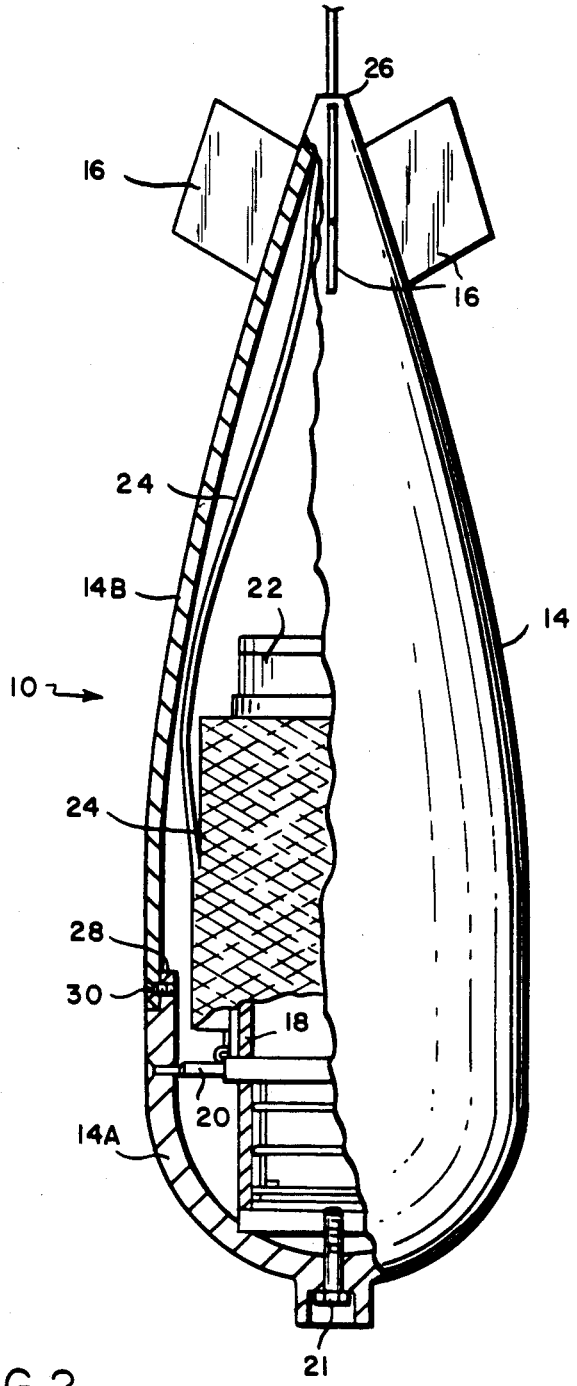
FIG. 2 is an enlarged, partially cut away view of the platform shown in FIG. 1.

As best seen in FIGS. 1 and 2, a line 24 is wound on mandrel 18 when the platform is positioned for descent. The line 24 is precision wound with a relatively high packing factor, for example, 80% of the total volume occupied by the line should be line while the balance of 20% should be the space between wraps of the line, so that the total line volume is as small a possible.

The line 24 should be formed of a material having a high tensile strength and a high elastic modulus (and thus very little stretch). It is also preferable that the material of line 24 be substantially neutrally buoyant in salt water so that the line does not add to the buoyant weight of the platform and that, as line feeds from the mandrel during descent the missing line is replaced by water which fills body 14, the buoyant weight of platform 10 remains substantially unchanged. This permits the platform 10 to descend at a substantially uniform rate.

Synthetic materials which substantially satisfy the criteria indicated above are Kevlar which is the trademark name for a synthetic fiber produced by Du Pont Corporation, and Spectra which is a trademark name for a fiber produced by Allied Chemical Corporation. Spectra is superior for the application of this invention in that it is much closer to being neutrally buoyant in water (specific gravity Kevlar=1.4, specific gravity Spectra=0.98).

Line 24 feeds from the outside of the windings on mandrel 18 and passes out of body 14 through an opening or hole 26 formed in the center of the body's stern. The hole 26 should preferably be aligned with the center stem to stern axis of body 14 and should be large enough so that line 24 easily passes therethrough. The inner surface of the opening may be coated with low friction materials such as Teflon to reduce wear and friction on line 24.

As may be best seen in FIG. 2, body 14 is formed in two parts, a stem part 14A and a stern part 14B. Portions of the two parts overlap at junction 28 and are held together at that point by one or more screws, pins or other suitable means 30. The two sections of body 14 may also be screwed together or held together in some other suitable manner known in the art. When screw(s) 28 is removed, the two sections of body 14 may be separated to permit an empty mandrel 18 (see FIG. 3) to be replaced with a mandrel having line 24 wound thereon. Body 14 may also be taken apart to change the payload 22 in the platform or to obtain samples or readings from the payload.

Referring to FIG. 1, a portion 32 of line 24 which is adjacent to platform 10 when line has been fully played out from mandrel 18 is formed of an elastic material, such as for example nylon. The section 32 of the line thus serves as a "shock absorber" at the end of the platform's descent to prevent excessive force or tension from being applied to line 24 at this point and to thus assure that the line does not break. This is particularly important where the platform 10 is heavy compared to the working strength of the line.

A similar result may be achieved by providing a braking mechanism in platform 10 which engages the line to slow its feed when it is detected that the line is nearly fully fed. For example, a detection mechanism could detect when there are a predetermined number of wraps on mandrel 18 and be operative when detection occurs to cause rollers positioned near hole 26 to engage line 24, slowing the lines exit through the hole.

Referring to FIG. 1, when platform 10 is being lowered or deployed, there is some slack in the line 24 between the vessel 12 and the point below a buoy 36 to which line 24 is attached. Having the platform descend from the buoy 3 rather than directly from the ship provides two potential advantages.

First, the buoy 36 is designed to have very limited response to surface waves and therefore isolates the platform from any rolling dynamics of the vessel 12. While these dynamics have virtually no effect on the platform when the platform is at substantial depths, they can cause some irregularities in the platform movement during the early stages of descent. The isolating buoy 36 eliminates this potential problem.

Second, buoy 36 can be pulled down by platform 10 when it reaches the end of line 24 to provide basically the same shock absorber effect as is provided by elastic section 32. However, while the buoy 36 can effectively provide this function when the platform 10 is deployed at relatively shallow depths, such as for example up to 500 meters, at greater depths, such as for example at 6000 meters, the drag of the line 24 would be such that the shock force of the platform reaching the end of line 24 would not be transmitted back to buoy 36 and therefore, when the mass of the platform is sufficiently large to generate a shock load which might break the line, elastic section 32 or some other momentum absorbing mechanism is required.

On vessel 12, line 24 is passed over standard elements such as a fair lead pulley 40 which takes the full load of the platform and which guides the line onto a hauling mechanism 42; the hauling mechanism 42 which may be, for example, a grooved drum hauling device; some number of idler accumulator pulleys 43 between the hauler 42 and a precision winder 44; a standard guide 45 for controlling the winding of line 24 on mandrel 48; and a control idler 46 which senses line tension and provides feedback control of the line tension onto the rewind mandrel 48. Mandrel 48 is removably mounted on the motor 53 driven winder 44. The tension on line 24 between hauler 42 and winder 44 causes idler 46 to rotate on arm 54, the idler being forced up when tension is higher and moving down when tension is eased. A suitable position sensing circuit 55 (FIG. 1) is provided for sensing the position of idler 46 or of arms 54 and for converting this into a signal which is applied to control the speed of winder 44 so as to maintain a substantially constant tension on line 24 as it is being wound on mandrel 48.

In operation, platform 10 having a mandrel 18 fully wrapped with line 24 is dropped from vessel 12 into water 60. Buoy 36 is attached to the line at a point just outside where the line 24 exits hole 26 in the stern of body 14 permitting there to be a certain amount of slack line between pulley 40 and the point at which the line connects to buoy 36. When platform 10 hits the water, it begins a free fall with line 24 being played off from mandrel 18 as the platform drops. Water 60 is permitted to enter body 14 through opening 26 and possibly other openings so that the body is substantially full of water during the descent. Thus, as line 24 plays out, it is replaced by water. With line 24 being formed of a substantially neutrally buoyant material such as Spectra, this means that the total weight of platform 10 will remain substantially unchanged during the descent.

The speed of descent of the body 10 is a function of a number of factors including the buoyant weight of the platform (i.e., its weight in water) and the hydrodynamic drag on the system. Since with the configuration of this invention, the line 24 is stationary in the water and therefore does not contribute to the hydrodynamic drag, the drag is only that caused by body 14. The hydrodynamic drag on the body may be empirically defined as:

$$D=0.5\ PV^2Cd\ A \qquad (1)$$

where:

D=hydrodynamic drag
P=the dynamic pressure of fluid
V=the velocity of platform 10
Cd=the drag coefficient of the body 14
A=a cross sectional area of the body 14.

In addition, at free fall velocity, the drag force D equals the net negative buoyancy.

By adjusting one or more of the variables indicated in equation 1 above, a desired free fall rate for platform 10 can be obtained. Theoretical free fall rates in the range of 7 to 10 meters per second, more than two to three times the rate with existing systems where cable is fed from the structure 12, are possible utilizing the teachings of this invention.

As platform 10 descends, instruments in package 22 may be taking readings which readings are preferably stored in a computer memory device included with the package. Alternatively, one or more conductive wires or cables may be incorporated with line 24 and used to transmit readings to the surface. The transmitted readings would be received by a suitable receiver on structure 12. However, the danger of such wires becoming broken in use makes this mode of operation less practical than merely storing the readings taken by the instruments in package 22 for later read out and use.

As line 24 is being fed off of mandrel 18 and being replaced by sea water 60, the water in body 14 applies viscous damping to line 24 as the windings are pulled off mandrel 18. This assists in preventing looping and kinking of the line as it is drawn off mandrel 18.

Assuming that the platform 10 reaches the end of line 24 before reaching the bottom of the body of water 60, the line 24 between buoy 36 and platform 10 is pulled taut. Elastic section 32 of line 24 (FIG. 3) serves to absorb the shock tension on the line 24 as platform 10 reaches the end of its travel. To the extent the drag on line 24 does not prohibit it, buoy 36 may also be pulled down when the platform reaches the end of its travel to further cushion the line against breakage as a result of the terminal forces applied to the line to stop the body.

The extreme distal end of line 24 is secured in a suitable manner to platform 10. This may be accomplished by tying or otherwise securing the platform to mandrel 18, by securing the line to some other solidly mounted element in platform 10 or by other suitable means.

Figure 3:
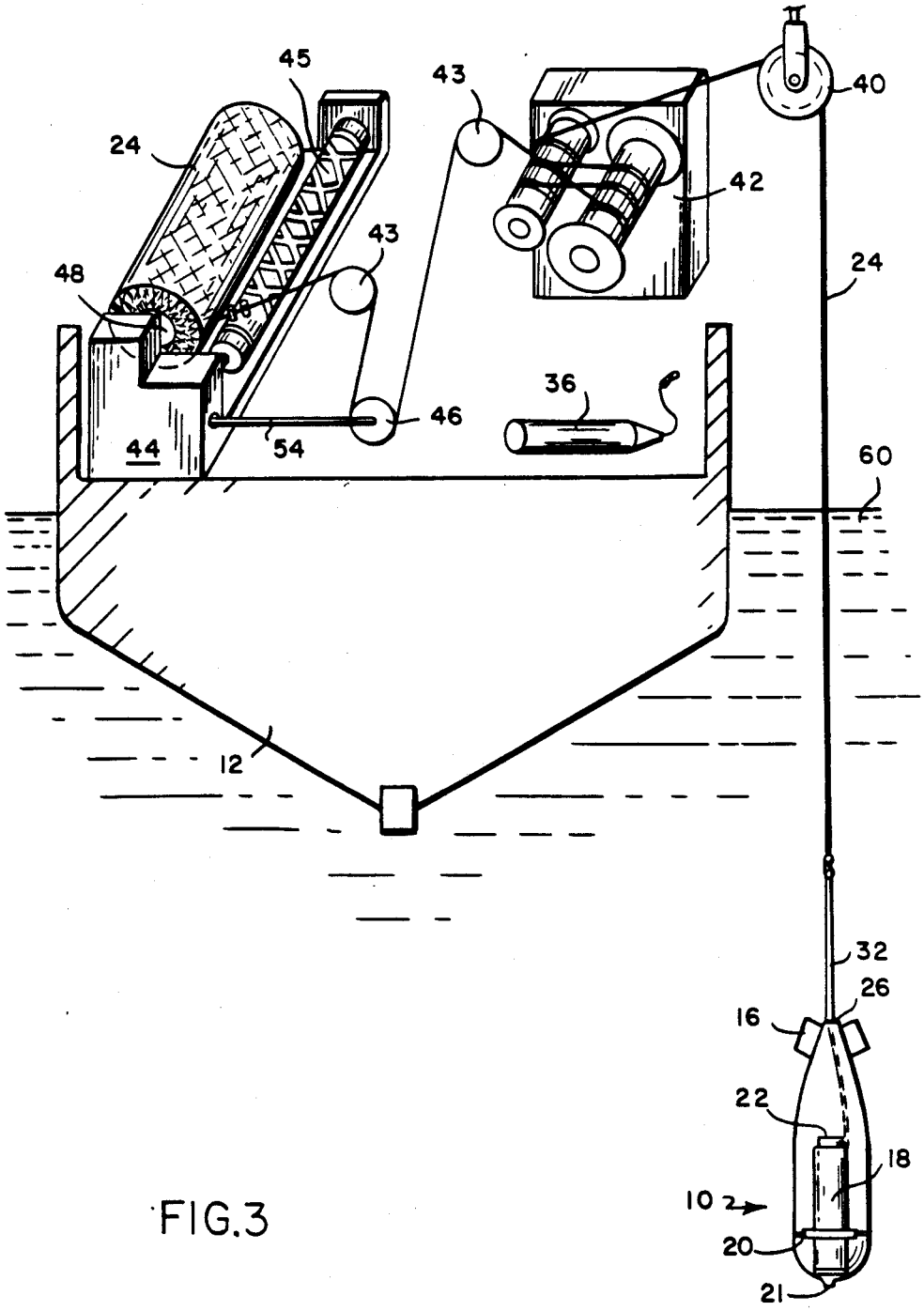
FIG. 3 is a semi schematic diagram of the system shown in FIG. 1 during recovery of the platform.

Referring to FIG. 3, it is assumed that when platform 10 is to be retrieved, hauler 42 and winder 44 are initially operated to rotate mandrel 48 a few turns to take up the slack in line 24 between pulley 40 and buoy 36 and to raise buoy 36 so that it may be hand removed from line 24. Hauler 42 and winder 44 are then set in operation to raise platform 10 and to rotate mandrel 48, causing line 24 to be wrapped on mandrel 48 as the platform is raised.

The primary limiting factor on the speed at which the retrieval operation may be performed is the breaking strength of line 24. The recovery drag on the line, not counting any dynamics which may be caused by movement of vessel 12, is equal to the sum of the buoyant weight of platform 10, the drag of platform 10 and the drag of line 24. The variables which go into determining these factors, and thus which go into determining the tension on the line 24 at any given time, may be classified separately as constant, depth dependent variables, velocity dependent variables and acceleration dependent variables. One example of a constant factor is the buoyant weight of the platform 10. The drag due to movement of the line 24 through the water is an example of a factor which is linearly dependent on the length of the line, and thus varies with the depth of the platform as it is being recovered. This drag, and also the drag of the platform 10 are functions of the square of the velocity through the water. Thus, doubling the velocity causes a fourfold increase in drag.

If, for example, line 24 is formed of Spectra and is approximate 0.19 inch in diameter, the line's maximum safe static working load or tension would be approximately 650 pounds. If it is assumed that the buoyant weight of the platform is approximate 150 pounds and that the drag forces on the platform are approximately the same, i.e., during descent drag=weight), this means that the drag component due to line 24 cannot exceed 350 pounds. For a Spectra cable of the type previously discussed it can be shown that at 7 meters per second, 350 pounds of drag will be achieved with only approximately 1350 meters of line in the water. Therefore, if it is desired to go to substantially greater depths, such as for example to 6000 meters, and it is desired that both the rate of descent and recovery be the same so that readings taken during descent may be checked during recovery, the strength of the line may impose severe restrictions on the ultimate speed at which the system may be operated.

However, this limitation also reduces the power requirements on hauler 42. Further, in the event there is no matched descent/ascent speed requirement, it is possible to take advantage of the linear relation between drag and depth. As platform 10 approaches the surface, the length of line 24, and thus the drag imposed by the line, decreases. This permits velocity to increase without excessively loading the line. Thus, by using a constant power motor to drive hauler 42 during the rewind operation, which motor initially operates slightly below the potential breaking strength of line 24, the rate of recovery will increase as the drag caused by line 24 decreases so that the total time for recovery is minimized for a given strength of line 24.

In those situations where it is desired to maintain a constant speed for the recovery in order to obtain uniform readings, the operating rate of hauler 42 can be adjusted to achieve this objective. To the extent the rate at which platform 10 can be recovered because of the factors indicated above is less than the free fall rate for the platform, the free fall rate can be adjusted by varying the buoyant weight or the drag of the platform, so that the fall and recovery rates are substantially equal.

The line 24 passing over idler 46 causes movement of the idler, as previously indicated, depending on the tension on this line. Since it is desired that line 24 be wrapped on mandrel 48 with a substantially constant tension, and thus a substantially constant packing factor, the movement of idler 46 as a result of the tension on line 24 may be monitored by position sensing mechanism 55 and, utilizing standard servo-control circuitry, the operating speed and/or power of the winder 44 may be adjusted so as to keep this tension constant.

When platform 10 has been recovered on vessel 12, screw or screws 30 (FIG. 2 may be removed, permitting sections 14A and 14B to be separated. Payload container 22 may then be removed to permit accumulated data to be retrieved or to permit the recovery of any samples. Container 22 may then be loaded either with the same workload or with a ne workload and replaced in body 14. Similarly, mandrel 18 which is now empty may be removed and replaced with for example mandrel 48 which is now fully wound with line 24. If the line is to be reused in this way, and elastic section 32 is required, such section may be required at both ends of the line so as to always be available at the distal end. Line would be fed from the end of the line wrapped on this mandrel through opening 26. Once these operations have been completed, body 14 may be reassembled, and screw or screws 30 replaced. Platform 10 is now ready to be redeployed. The mandrel 18 removed from platform 10 may be mounted as the mandrel 48 on winder 44 for the next rewind operation.

While in the discussion above, it has been assumed that vessel 12 is nearly stationary while platform 10 is deployed, it is apparent that the teachings of this invention could also be utilized where the vessel 12 is in motion. However, the velocity for determining drag forces on recovery would be the sum of the velocity of the vessel plus the velocity at which line 24 is being moved by the hauler 42. Since drag forces are equal to the square of the velocity, this would result in very high drag forces on the line and on body 14 during recovery and would mean that the speed of hauler 42 might need to be slow due to the velocity component of the vessel 12, and therefore, recovery may have to be accomplished slowly. In the alternative, the depth of deployment may be limited, or, the vehicle might have to slow down or even stop in the water to permit recovery to be accomplished at a reasonable rate.

Further, while for the preferred embodiment shown in the figures, the mandrel 18 is aligned parallel to and substantially coaxial with the center stem to stern axis of the platform, it is also possible, particularly in larger platforms, that it may be desirable for particular payloads to mount the mandrel with its axis intersected by and substantially perpendicular to the center stem-to-stern axis. Under these conditions, the mandrel could be made rotatable with the line being fed through a guide substantially aligned with the center stem-to-stern axis and through hole 26. If rotation of the mandrel is to be avoided with a perpendicular mounted mandrel, the line coming off the end of the mandrel would need to be fed over a pulley or guide substantially aligned with the mandrel axis to a guide substantially in line with the center stem-to-stern axis of body 14 before passing through hole 26. The primary objective with all of the configurations described above is to avoid unbalanced off axis forces from being applied to platform 10 so that the platform is not caused to spin or wobble excessively during its descent.

In addition, while for the preferred embodiment both mandrel 18 with line 24 wound thereon and container 22 for the payload are mounted within body 14, this is not a limitation on the invention. For example, with a large payload, it may in some applications be desirable to mount the mandrel and line outside of body 14 with suitable guide mechanisms. Where the mass of the payload is sufficient to achieve the desired free fall rate and to provide hydrodynamic stability, it may be possible to construct a platform that does not require a body 14.

In addition, while the shape of body 10 and the positioning of fins 16 at the stern provide stability for the body during deployment or descent, in some applications a need may arise to also provide stability for the platform during recovery. This may be achieved in a variety of ways. For example, a suitable means may be provided for inverting the platform during retrieval so that the stem during descent is also the stem during retrieval. Additional stabilize fins 16 may be provided near the stem of the body to provide stability or some means may be provided for moving the fins 16 from the stern to the stem of the platform during retrieval.

While, in the figures the vessel 12 is shown generally as a ship or boat, it is apparent that the teachings of this invention could be practiced from an above water station such as an oil rig or pier or from a helicopter positioned above the water surface. The exact hauling and winding mechanisms utilized for recovery are also not specifically part of this invention and may be varied depending upon application.

Thus, while the invention has been specifically shown and described above with respect to a preferred embodiment, the foregoing and other changes of form and detail may be made therein by one skilled in the art without departing from the spirit and scope of the invention.

What is claimed is:

1. A recoverable tethered platform comprising:

a mandrel;

a line wrapped on said mandrel;

a payload;

a body having at least two sections in which said mandrel and said payload are mounted;

said line being fed from the mandrel as the platform is deployed;

means for securing the distal end of the line to the platform, whereby the platform may be recovered; and means for permitting the two sections of said body to be sufficiently separated to permit an empty mandrel to be removed after recovery and replaced with a new mandrel having line wrapped thereon.

2. A platform as claimed in claim 1 wherein said line is of a high tensile strength, high modulus fiber.

3. A platform as claimed in claim 1 wherein the platform is adapted to be deployed in water and wherein said line is of a material which is substantially neutrally buoyant in water.

4. A platform as claimed in claim 1 wherein said mandrel is mounted with its axis substantially coaxial with the center stem to stern axis of said body.

5. A platform as claimed in claim 1 wherein said platform is adapted to be deployed in water, wherein said body fills with water as it is deployed, and wherein said line is of a material which is substantially neutrally buoyant in water, whereby the buoyant weight of the platform remains substantially constant during deployment.

6. A platform as claimed in claim 1 including an opening in the stern wall of said body through which line is fed from said body, said opening being positioned to enhance the stability of the platform.

7. A platform as claimed in claim 1 including means for stabilizing said platform.

8. A platform as claimed in claim 7 wherein said body is hydrodynamically stable; and wherein said means for stabilizing includes stabilizing fins mounted to the stern of the body at least during deployment of the platform.

9. A platform as claimed in claim 1 including means for controlling the buoyancy and/or the drag of the body to achieve a desired free fall deployment rate.

10. A platform as claimed in claim 1 wherein the mass forming said platform is distributed so as to enhance the stability thereof.

11. A platform as claimed in claim 1 including means for reducing the impact loading applied to the line when the platform is stopped at the end of its deployment.

12. A platform as claimed in claim 11 wherein said impact loading reducing means includes an elastic section attached near the distal end of said line which absorbs momentum as the platform is being stopped.

13. A platform as claimed in claim 1 wherein said line is precision wound on said mandrel.

14. A recoverable tethered platform system for use in a body of water having an upper surface comprising:

a platform having a removably mounted mandrel, a line wound on said mandrel which line is drawn off said mandrel as the platform is deployed, a payload mounted to the platform, and means for securing the distal end of the line to the platform; and a means for platform recovery which is mounted on a station at or above the water surface including:

a precision winding mechanism, a recovery mandrel interchangeable with the platform mandrel removably mounted to the winding mechanism, and a hauling means for recovering the platform and feeding line to the mandrel mounted to the winding mechanism.

15. A system as claimed in claim 14 including means for controlling the tension on the line as applied to the winding mechanism so as to maintain said tension within predetermined limits.

16. A system as claimed in claim 15 wherein said means for controlling tension includes an idler the position of which varies with the tension on the line, and means responsive to idler position for controlling speed of said winding mechanism.

17. A system as claimed in claim 14 wherein, after recovery when line is fully wound on said recovery mandrel, said removably mounted mandrel may be replaced on said platform by said recovery mandrel, whereby said platform may be redeployed.

18. A system as claimed in claim 14 wherein said platform is a free fall platform.

19. A system as claimed in claim 18 including means for controlling the buoyance and/or drag of the platform and thus its rate of fall so that the fall rate of the platform and the rate at which it is recovered are substantially the same.

20. A system as claimed in claim 14 including means for absorbing the momentum of said platform when the platform reaches the end of said line.

21. A system as claimed in claim 14 including a buoy, and means for connecting the line to the buoy during deployment of the platform with some slack in the line between the station and the buoy.

* * * * *